United States Patent [19]

Berg

[11] 4,402,321

[45] Sep. 6, 1983

[54] COMFORTER

[76] Inventor: Marie-Louise Berg, 27 Drosselvej, 4000 Roskilde, Denmark

[21] Appl. No.: 252,978

[22] PCT Filed: Sep. 19, 1979

[86] PCT No.: PCT/DK79/00034

§ 371 Date: May 13, 1980

§ 102(e) Date: May 13, 1980

[87] PCT Pub. No.: WO80/00657

PCT Pub. Date: Apr. 17, 1980

[30] Foreign Application Priority Data

Sep. 20, 1978 [DK] Denmark ..... 4173/78

[51] Int. Cl.[3] ..... A61J 17/00

[52] U.S. Cl. ..... 128/359; 128/360

[58] Field of Search ..... 128/359, 360, 252

[56] References Cited

U.S. PATENT DOCUMENTS

| | | | |
|---|---|---|---|
| 139,958 | 6/1873 | Hobson | 128/252 |
| 411,794 | 10/1889 | Eggers | 128/252 |
| 1,937,278 | 11/1933 | Kleine | 128/252 |
| 2,025,508 | 12/1935 | Herstein | 128/252 |
| 2,707,470 | 5/1955 | Greene | 128/252 |
| 3,335,890 | 8/1967 | Grundmann et al. | 128/252 |
| 4,193,407 | 3/1980 | Edmark | 128/360 |

FOREIGN PATENT DOCUMENTS

| | | | |
|---|---|---|---|
| 1902772 | 9/1973 | Fed. Rep. of Germany . | |
| 779618 | 4/1935 | France . | |
| 27198 | of 1910 | United Kingdom . | |
| 16193 | of 1915 | United Kingdom | 128/252 |
| 569688 | 5/1945 | United Kingdom . | |
| 641314 | 8/1950 | United Kingdom . | |

*Primary Examiner*—Kyle L. Howell
*Assistant Examiner*—C. W. Shedd
*Attorney, Agent, or Firm*—Oblon, Fisher, Spivak, McClelland & Maier

[57] ABSTRACT

A comforter comprises a safety shield (2) and a teat rubber (1) formed integral with a circumferential collar (4). This collar (4) abuts and covers the surface of the safety shield in front of the mouth and forms an inclining movable contact surface resembling a mamma. The peripheral rim area of the collar includes a solid rim (4') forming an extra protection and preventing the comforter from being swallowed. Fastening means are also provided in the form of for instance a locking disk (3) and a securing member is provided in the form of for instance an inwardly turned circumferential marginal flange (5) for maintaining the teat rubber (1) and its collar safely upon the safety shield (2).

1 Claim, 6 Drawing Figures

COMFORTER

TECHNICAL FIELD

The present invention relates to a comforter comprising a safety shield and a teat rubber moulded integral with a circumferential collar, the thickness of which corresponds substantially to the thickness of the teat rubber.

BACKGROUND ART

Usual comforters comprise a plug maintaining the teat rubber in the centre of the safety shield. The baby may place such a comforter so that the hard safety shield preventing the baby from swallowing the comforter abuts the rim of the lower teeth whereas the upper front teeth abut the portion of the plug extending a short distance downwards through the hole of the rubber teat. As a result the front upper teeth are subjected to a heavy pressure from below. However, the baby may bite so hard in the rubber plug end that the teeth bite through the rubber and finally bite said rubber in two so thaat the baby may either swallow said rubber or get it into the trachea. Furthermore, these known comforters have the drawback that it is impossible to keep the connection between the rubber and the plastic placed immediately in front of the mouth bacteria-free. The baby may also be sucking these known comforters so that a vacuum arises in the oral cavity involving a deformation of the palate so that the palate becomes high and narrow. This drawback may influence the rudiment for the permanent teeth present above the milk teeth in the jawbone so that the permanent teeth become malpositioned or pointed outwards. Moreover, the baby may by means of the known comforters form a tight loop beneath the front teeth by pushing the teat rubber backwards against the palate with the tongue. Although the outer shape of these comforters may resemble the mamma, they have all the above drawbacks.

British patent specification No. 27,198 discloses a comforter comprising a safety shield and a teat rubber, the projecting collar of which surrounds the plane safety shield and is tightened thereabout, said collar comprising a flange curved backwards. This comforter comprises a plane, rigid surface facing the mouth of the baby and may imply excoriation about the mouth. This surface comprises no movability. The teat rubber is the natural rubber usually used for all comforters today, and then influenced by the saliva this rubber dissolves and swells in such a manner tht the surface after use for a short time is porous, which provides favourable conditions for bacteria. By storage for a long time the rubber oxidizes and turns hard, which implies tht a baby may easily bite the teat body into two and either swallow said body or get it into the trachea. As a consequence of the crumbling of the teat rubber, requirements exist for the lifetime for the rubber, before the expiration of which the comforters must be returned to the producer.

DISCLOSURE OF INVENTION

The object of the invention is to provide a comforter comprising a safety shield, the teat rubber and associate collar of which are loosely movable, and which to a far higher extent than previous comforters resembles a mamma.

The comforter according to the invention is characterised in that the collar strainlessly abuts and substantially only covers the entire surface of the safety shield in front of the mouth and furthermore inclines upwards towards or along said safety shield to form a movable contact surface for the lips of the baby, whereby the collar along its outer rim area comprises an outwardly directed, circumferential, solid rim moulded integral with said collar and loosely abutting the peripheral surface of the safety shield opposing the mouth or projecting beyond said safety shield. In this manner it is inter alia obtained that the rubber is movable, whereby the comforter resembles a mamma and the comforter is more hygienic in use as no connection between the rubber and the plastic is present immediately in front of the mouth of the baby as by the comforters commonly used today. Owing to the flexibility of the collar it is obtained that the baby cannot suck so that a vacuum arising in the oral cavity may deform the palate, and furthermore that the baby by means of the soft collar rubber in front of the mouth may form a tight loop under the front teeth by pushing the teat rubber backwards against the palate. The baby cannot swallow such a teat rubber with a collar and a solid rim, even if said teat rubber should be torne from the safety shield. Thus the circumferential solid rim forms an extra protection. Finally, it is in a simple manner obtained that the groove in front of the mouth of the baby by known comforters and which is subjected to the risk of being filled with saliva and thereby attacked by the detrimental agents of the saliva, is not adjacent the area of the mouth. In addition the loosely abutting rim ensures an easy cleaning.

It is according to the invention preferred that the collar, the solid rim thereof, and the teat rubber moulded integral therewith are manufactured of a soft, resilient material preferably chemically inactive towards saliva. Thereby the risk of biting the teat rubber in two is reduced, since the usual rubber is decomposed by the saliva and starts crumbling. Furthermore, it is preferred that the material used is silicon rubber.

In order to maintain the teat rubber on the safety shield it is according to the invention preferred that a securing member for securing the teat rubber and the collar to the safety shield by co-operating with a fastening means is provided on the side of the collar opposing the safety shield and moulded integral with said safety shield, whereby the collar optionally projects beyond said safety shield.

Moreover according to the invention the fastening means may be a locking disk comprising a central projection welded or glued to the rim of a central hole in the safety shield, and the securing member of the teat rubber may be a circumferential marginal flange turned inwards and moulded integral with the collar and furthermore clamped between the rim edge or rim surface and the surface of the safety shield opposing the locking disk, whereby a simple and efficient securing of the teat rubber is ensured.

In order to provide an additional securing, it is according to the invention preferred that the rim of the marginal flange facing the centre comprises a circumferential bead clamped between the safety shield and the locking disk.

An additional securing may be obtained by the bead being fixed behind a circumferential rib placed radially outside said bead and on the safety shield, said bead being clamped between said safety shield and the locking disk.

According to an alternative embodiment of the comforter according to the invention, the fastening means is a locking ring having a substantially U-shaped cross section with two legs, whereby the inner sectional leg is welded or glued to the safety shield, and the outer sectional leg ends a short distance from the safety shield, and the securing member of the teat rubber is a circumferential marginal flange turned inwards and moulded integral with the collar and with a circumferential bead along the rim of the inner marginal flange, said bead being clamped in the hollow space of the U and towards the surface of the safety shield. This embodiment renders it possible to exert a pull of more than 25 kg in the teat rubber without separating the parts, which also applies to the above embodiments.

According to a third embodiment, whereby a sufficient mutual securing of the parts is also ensured, the fastening means comprises a hollow projection having a first lower circumferential rib, and a cylindrical portion welded or glued to the lower marginal surface of the projection and having a second lower circumferential rib, whereby the projection and the portion are introduced from their respective side into the central hole of the safety shield, the diameter of said central hole corresponding to or being a short distance smaller than the largest diameter of the ribs, said ribs having a mutual distance being somewhat larger than the thickness of the safety shield, and whereby the securing member of the teat rubber is a ring flange moulded integral with and extending upwards from the collar, said ring flange being placed adjacent the connection between the collar and the teat body of the teat rubber and comprising a bead and furthermore being clamped in the annular opening formed between the cylindrical portion and the wall of the hole of the safety shield, whereby the bead is located above the safety shield and the first rib. As a result both a collar loosely abutting the safety shield to form a soft sucking surface and a particular pull-resistant fastening by means of the vertical, upright ring flange with bead are obtained.

It is according to the invention preferred that the hollow space formed by the collar, the teat rubber, and the safety shield communicates with the surrounding air, so as to ensure an appropriate softness of the teat rubber.

Furthermore it is preferred that the solid rim coincides with the peripheral rim surface of the safety shield opposing the mouth or projects beyond said rim surface, whereby the entire surface of the safety shield opposing the mouth is uniformly covered by a flexible, resilient layer forming a movable contact surface towards the lips of the baby.

It is obvious that all the above embodiments may be manufactured with or without a ring, and that the comforters without a ring are essentially flatter than any of the known comforters.

BRIEF DESCRIPTION OF DRAWINGS

Preferred embodiments of the comforter according to the invention will be described below with reference to the accompanying drawing, in which.

BEST MODE FOR CARRYING OUT THE INVENTION

Figure 1:
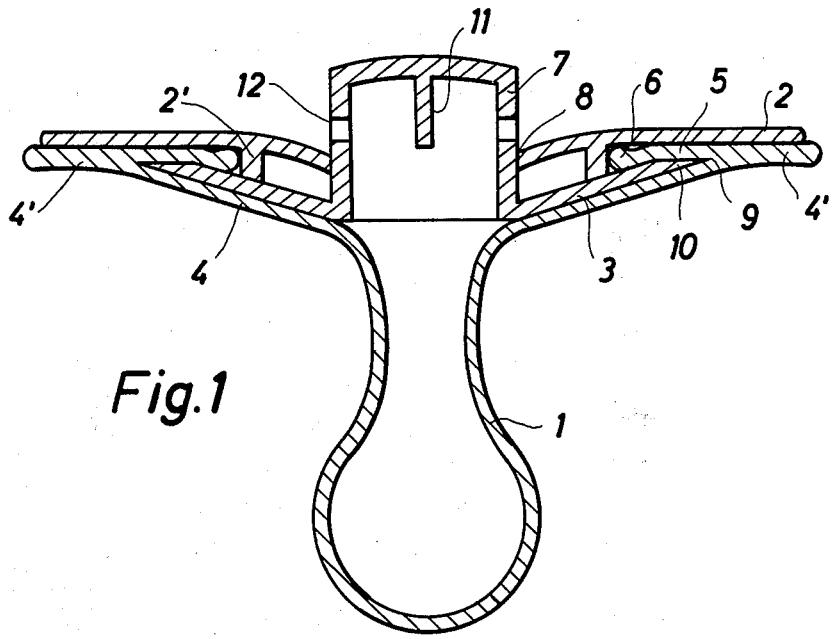
FIG. 1 illustrates a first embodiment of a comforter.

The comforter illustrated in FIG. 1 comprises a teat rubber 1, a safety shield 2 which inter alia ensures that a baby cannot swallow the comforter, and a locking disk 3. The teat rubber comprises a collar 4 substantially covering the entire surface of the safety shield 2 opposing the mouth of the baby. The collar 4 is moulded integral with the teat rubber and comprises a circumferential marginal flange 5 turning inwards and preferably ending in a bead 6. The locking disk 3 comprises a central projection 7 extending upwards through a central hole 8 in the safety shield 2. This central projection is welded or glued to the upper or lower inner rim of the central hole. The welding is preferably performed by ultrasound or heat welding. The locking disk 3 comprises a relatively sharp rim edge 9 and a rim surface 10 opposing the safety shield 2. The central projection may be hollow and comprise a central wall 11 positioning a ring (not shown). Furthermore, holes receiving a ring (not shown) may be provided in the wall of the central projection. Along the outer rim area, the collar 4 comprises a solid rim 4' moulded integral therewith and loosely abutting the surface of the safety shield opposing the mouth. In this embodiment the rim 4' is very solid to form an extra protection so that the baby does not swallow the teat rubber in case said teat rubber should be used independently of the safety shield and project a short distance thereabove. A circumferential projection 2' is provided a short distance within or adjacent the bead 6 on the safety shield 2, said projection being moulded integral with said safety shield. This projection abuts the locking disk 3 and is welded thereto. In this manner the assembled ends of the locking disk 3 and the safety shield 2 are prevented from separating and thereby from forming an opening during boiling of the comforter owing to the softer consistency of the plastics when heated. In this manner the projection 2' ensures the securing of the bead 6.

In an air filled comforter is desired, the central projection 7 may for instance be moulded in a solid form.

Figure 2:
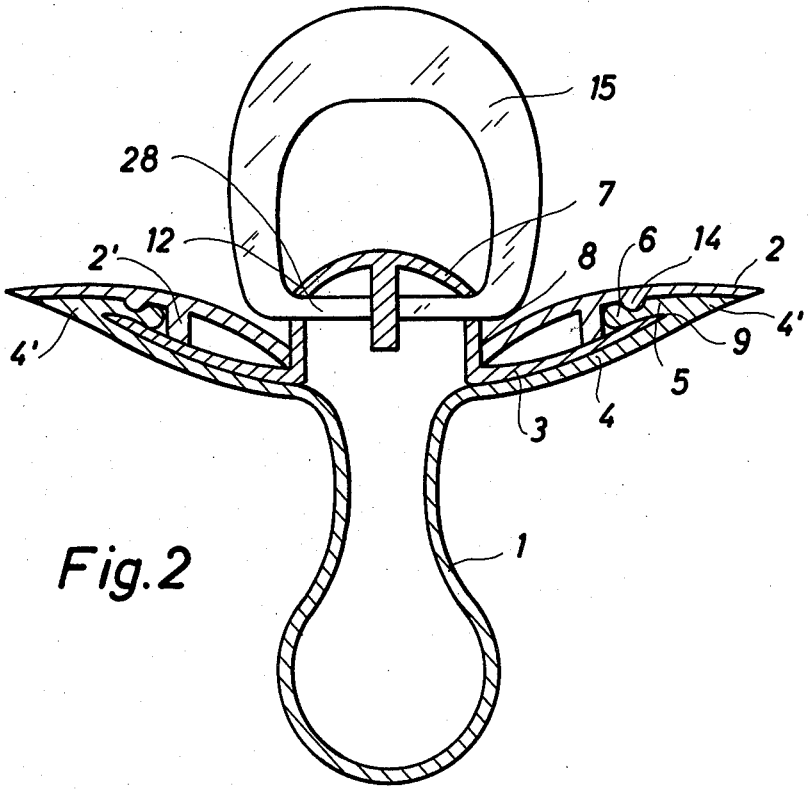
FIG. 2 illustrates a variation of the embodiment of FIG. 1.

FIG. 2 illustrates an embodiment of the comforter according to the invention, which deviates slightly from the comforter of FIG. 1 by a circumferential rib 14 in this embodiment being placed on the safety shield 2. This circumferential rib opposes in radial direction the bead 6 of the marginal flange 5 of the collar 4 when the comforter is assembled. Thereby it is further ensured that the collar is prevented from being pulled out in radial direction. The end of the solid rim 4' coincides with and extends uniformly into the bevelled rim surface of the safety shield or may project therebeyond to achieve a higher movability.

Furthermore, a flat ring 15 comprising projections 28 is shown in this drawing. These projections extend substantially perpendicular to the upright parts 29 of the ring, whereby the projections in spite of a strong pull cannot slide out of the holes 12. The flat top portion of the ring is suited for gluing thereon a label.

Figure 3:
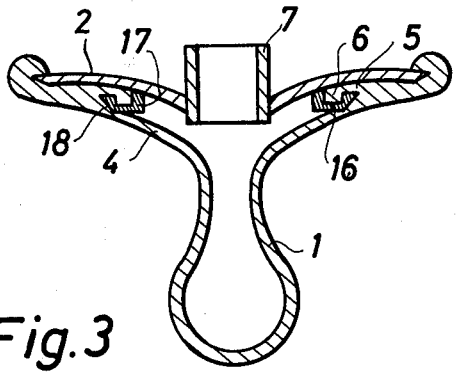
FIG. 3 illustrates a second embodiment of the comforter.
Figure 4:
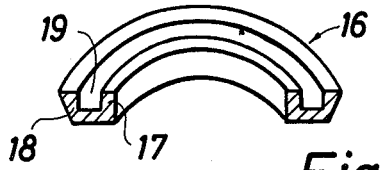
FIG. 4 illustrates a locking ring used in connection with the comforter illustrated in FIG. 3.

In the embodiment illustrated in FIG. 3, the teat rubber 1 also comprises a collar 4 and a solid rim 4' moulded integral with said collar. This solid rim surrounds the rim of the safety shield and thereby forms an extra strong protection so that the baby cannot swallow a loose teat rubber. The teat rubber 1 furthermore comprises a circumferential marginal flange 5 turned inwards and a bead 6, which is the securing member of the teat rubber, cf. above. The fastening means fastening the teat rubber to the safety shield 2 is in this embodiment a locking ring 16 having a substantially U-shaped cross section with two legs 17, 18. The inner sectional leg 17 is welded or glued to the safety shield 2 and the outer sectional leg 18 ends a short distance from the safety shield. The locking ring clearly appears from FIG. 4. A projection 7 for a ring (not shown) is furthermore provided in the centre of the safety shield 2. When it is desired not to use a ring, the safety shield may be formed as a completely flat or slightly curved disk without a central hole and a projection, whereby an air filled teat rubber is obtained which simultaneously ensures that the comforter is as flat as possible and does not hamper the baby in bed.

The comforter illustrated in FIG. 3 is assembled by everting the bead 6 downwards into the hollow space 19 of the locking ring 16, subsequently pressing the locking ring firmly against the safety shield by a pressure opposite the inner leg 17, and finally assembling the locking ring and the safety shield by welding or gluing, preferably by ultrasound or heat welding.

Figure 5:
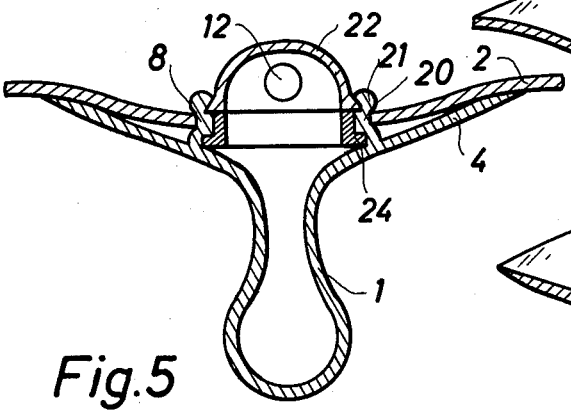
FIG. 5 illustrates a third embodiment of the comforter.
Figure 6:
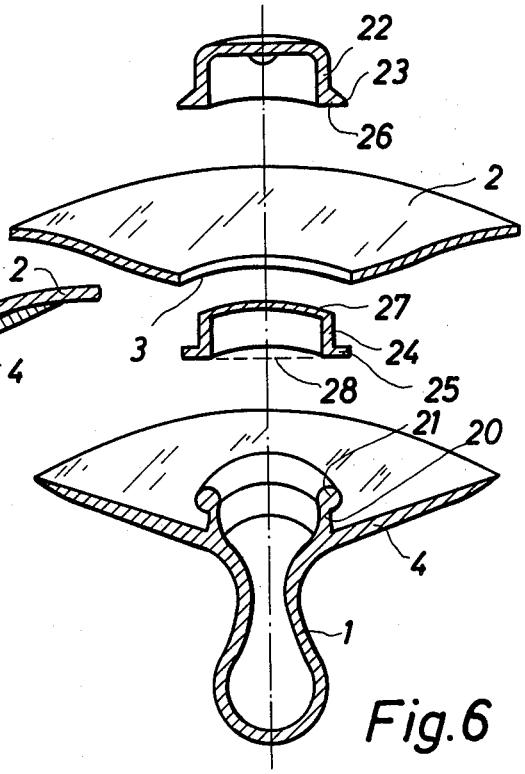
FIG. 6 is an exploded view of a comforter substantially corresponding to the comforter of FIG. 5.

According to the embodiment illustrated in FIGS. 5 and 6, the teat rubber 1 also comprises a collar 4 ending in a rim 4' moulded integral therewith. This rim 4' abuts the safety shield and is illustrated in the embodiment permitting the maximum possible movement of the collar 4. At the same time the solid rim 4' is tightened about the safety shield during sucking as a consequence of the consistency of the rubber, whereby penetration of liquid into the interspace between the safety shield and the collar is limited. This embodiment is particularly easy to clean. Unlike the other embodiments, an upright ring flange 20 is situated on the collar 4 adjacent the connection between the collar and the teat portion. At the top this ring flange 20 ends in a circumferential bead 21. The safety shield 2 comprises a hole 8. The fastening means is an annular hollow projection 22 comprising a first lower circumferential rib 23, and may have holes 12 receiving a ring (not shown). Furthermore, the fastening means comprises a cylindrical portion 24 comprising a second lower circumferential rib 25. At the final assembling, the projection 22 and the portion 24 are welded together along their abutting marginal surfaces 26 and 27, respectively. The diameter of the circumferential ribs 23, 25 corresponds to or is a small amount larger than the diameter of the central hole 8. If a comforter always filled with air is desired, a locking disk may be placed on the portion 24 at 28.

The comforter illustrated in FIGS. 5 and 6 is assembled by inserting the cylindrical portion 24 into the comforter, then pressing the ring flange 20 and the bead 21 upwards through the hole 8, subsequently pressing the annular projection 22 downwards into the ring flange of the comforter until the rib 23 is under the bead 21 and the marginal surfaces of the projection 22 and the portion 24 are in contact with each other, and finally welding these portions together by heat or ultrasonic welding. If gluing is used, a preferably two component glue of known art is applied to the two marginal surfaces 26, 27 before the assembling, whereafter the parts are pressed together.

Irrespective of the choice of embodiment, a comforter is provided comprising a large skin-like surface opposing the mouth of the baby, whereby the comforter to a higher extent than previously resembles a mamma. It is at the same time by means of the collar which may loosely abut the safety shield, cf. FIG. 5, obtained that sufficient rubber is present for preventing the teeth of the baby from reaching the very small and slightly projecting contact surfaces on the side of the safety shield opposing the mouth of the baby. Furthermore, a groove, in which bacteria may be present, is avoided immediately in front of the mouth of the baby.

I claim:

1. A comforter comprising:

a teat rubber having a hollow bulbous portion closed at one end and integrally attached at its open end to one end of a hollow elongated cylindrical member having a longitudinal axis, said portion and said member being intended for insertion into the mouth of a user;

a truncated generally conical flange attached at its smaller diameter to the other end of said member and arranged to taper outwardly from said axis and away from said portion;

said flange further comprising a substantially circular outer edge and attached thereto a rim having a first lip directed substantially radially inwardly toward said axis, said first lip terminating in a bead which is in spaced relation to said axis; said rim having a second lip directed substantially radially outward from said first lip and being coextensive therewith;

a safety shield shaped so as to extend between and contiguously adjoin a major portion of said conical flange surface directed toward said axis and the adjacent surface of said first lip; and fastening means overlying said rim such that said second lip is supported and said first lip is entrapped between said shield and said fastening means;

thus, securing together said comforter.

* * * * *